US005230201A

United States Patent [19]

Iuchi et al.

[11] Patent Number: 5,230,201

[45] Date of Patent: Jul. 27, 1993

[54] BLOCK FILLING APPARATUS

[75] Inventors: Tetsuya Iuchi; Takao Miki; Hisanori Hamada, all of Tokushima, Japan

[73] Assignee: Shikoku Kakoki Co., Ltd., Tokushima, Japan

[21] Appl. No.: 774,091

[22] Filed: Oct. 11, 1991

[30] Foreign Application Priority Data

Oct. 12, 1990 [JP] Japan ..... 2-107092[U]

[51] Int. Cl.[5] ..... B65B 05/00

[52] U.S. Cl. ..... 53/243; 53/251; 53/252; 53/253; 198/482.1; 198/803.7

[58] Field of Search ..... 198/408, 482.1, 803.7; 221/211, 224, 262; 53/242, 243, 250, 251, 252, 253

[56] References Cited

U.S. PATENT DOCUMENTS

| | | | |
|---|---|---|---|
| 1,429,093 | 9/1922 | Paranteau | 198/482.1 |
| 2,652,791 | 9/1953 | Liston | 198/482.1 |
| 2,683,557 | 7/1954 | Jenney | 53/243 X |
| 3,021,655 | 2/1962 | Chadima et al. | 53/252 X |
| 3,041,805 | 7/1962 | Fulco | 53/243 X |
| 3,108,714 | 10/1963 | O'Brien | 221/211 |
| 3,343,337 | 9/1967 | Dalle Vacche | 53/243 X |
| 3,659,744 | 5/1972 | Byrd et al. | 221/211 X |
| 3,683,584 | 8/1972 | Tigner | 53/243 X |
| 4,164,391 | 8/1979 | Howard et al. | 198/803.7 X |
| 4,305,691 | 12/1981 | Mayer | 221/211 X |
| 4,674,935 | 6/1987 | Feliks et al. | 221/211 X |
| 4,704,841 | 11/1987 | Lahgenbeck | 53/251 X |
| 4,823,934 | 4/1989 | Lemaire et al. | 198/803.7 X |

FOREIGN PATENT DOCUMENTS 53-6915 3/1978 Japan .

*Primary Examiner*—John Sipos
*Assistant Examiner*—Daniel Moon
*Attorney, Agent, or Firm*—Armstrong, Westerman, Hattori, McLeland & Naughton

[57] ABSTRACT

An apparatus for filling blocks into containers individually by placing the container as turned upside down over the block and inverting the container with the block fitted therein. A block feeder and a container feeder are arranged as horizontally spaced apart from each other. An intermittenly driven container-inverting slat conveyor has slats each adapted to stop at the block feeder and then at the container feeder while traveling along an upper path of transport of the conveyor.

5 Claims, 7 Drawing Sheets

BLOCK FILLING APPARATUS

BACKGROUND OF THE INVENTION

The present invention relates to an apparatus for filling blocks, especially fragile or soft blocks of dry noodles or the like, into cup-shaped containers.

For example, Examined Japanese Patent Publication SHO 6915/1978 discloses such a filling apparatus which is adapted to fill blocks into containers individually by placing the block on a container inverting rotary drum at a specified station, fitting the container as turned upside down over the block at the same station and rotating the drum with the block covered with the container.

The apparatus described has the advantage that the block is subjected to almost no external force during the filling process and can therefore be filled into the container without producing fragments or chips or deforming even if fragile or soft. However the apparatus has the following problem. Because the rotary drum must be held at rest while the block and the container are fed to the drum and further because the block and the container are fed individually, the drum needs to be held stopped for a prolonged period of time per cycle, so that the apparatus is not adapted for a high-speed filling operation.

SUMMARY OF THE INVENTION

The main object of the present invention is to provide a block filling apparatus free of the above problem.

The present invention provides a block filling apparatus which comprises an apparatus frame having a block feed station, a container feed station horizontally spaced apart therefrom and a discharge station vertically spaced apart from the two stations; an intermittently driven container-inverting slat conveyor having a plurality of slats, an upper path of travel of the slats and a lower path of travel of the slats, the conveyor being so adapted that each of the slats is stopped at the block feed station and then at the container feed station while traveling along the upper path and thereafter at the discharge station while traveling along the lower path; means for feeding a block to the slat stopped at the block feed station; means for feeding a container to the slat stopped at the container feed station to cover the block fed thereto with the container as turned upside down; means for releasably holding the container fed to the slat; and means for operating the holding means to cause the holding means to hold the container at the container feed station and cause the holding means to release the container at the discharge station.

With the block filling apparatus of the present invention, a block feeder and a container feeder are arranged as horizontally spaced apart from each other, and each slat of the intermittently driven container-inverting slat conveyor is adapted to stop at the locations of these feeders in succession while traveling along the upper path for receiving the block and the container as fed thereto at the respective stations, so that the period during which the slat is held at rest can be shorter than when the block and the container are fed at the same station as in the conventional apparatus described above. Consequently, the present apparatus can be driven for a high-speed filling operation.

DESCRIPTION OF THE PREFERRED EMBODIMENT

An embodiment of the present invention will be described below with reference to the drawings.

In the following description, the term "front" refers to the right-hand side of FIG. 2 and the term "rear" to the opposite side thereof, and the terms "right" and "left" are used as the apparatus is viewed from the rear forward.

Figure 1:
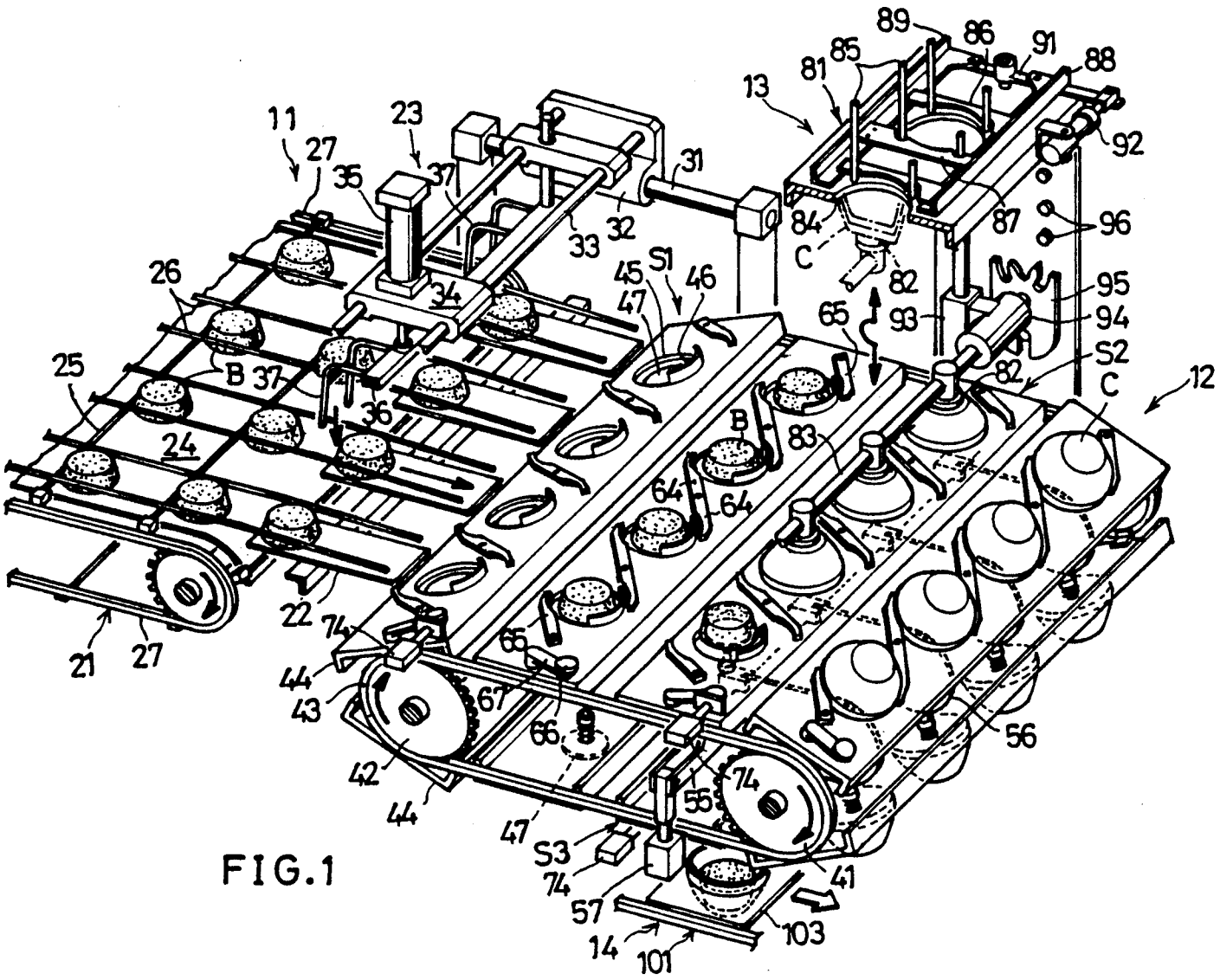
FIG. 1 is a perspective view showing an apparatus of the invention in its entirety.

FIG. 1 shows a block filling apparatus which comprises a block feeder 11, a container inverting conveyor 12 so disposed that the starting end of an upper path of travel thereof is located at the feed position of the feeder 11, a container feeder 13 disposed above the upper path of the container inverting conveyor 12, and a filled container delivery device 14 disposed below a lower path of travel of the container inverting conveyor 12.

The block feeder 11 comprises a block conveyor 21 extending longitudinally of the apparatus and having a transport path terminal end opposed to the upper path starting end of the container inverting conveyor 12 for transporting blocks B in four rows, four bridge plates 22 so disposed as to interconnect the block conveyor 21 and the inverting conveyor 12, and a pusher 23 for pushing blocks B from the block conveyor 21 onto the inverting conveyor 12 over the bridge plates 22.

The block conveyor 21 comprises a slide plate 24, a pair of right and left endless chains 27 arranged at the respective sides of the slide plate 24, a multiplicity of pusher bars 25 attached to the chains 27 and arranged at a spacing equal to the pitch of blocks B in the four rows, four pairs of horizontal guide bars 26 extending longitudinally of the apparatus above the slide plate 24 for guiding the respective rows of blocks B as held therebetween. The pusher 23 comprises a pair of right and left horizontal guide rods 31 extending in the longitudinal direction, a pair of right and left slidable sleeves 32 mounted on the respective guide rods 31 (the right slidable sleeve is not shown), a pair of front and rear horizontal support rods 33 extending between and attached to the slidable sleeves 32, a hydraulic cylinder 35 oriented vertically downward and mounted by a bracket 34 on the support rods 33, a horizontal lift bar 36 extending transversely of the apparatus and attached to the piston rod of the cylinder 35, and inverted L-shaped pushing members 37 attached to the lift bar 36, two members 37 being provided for each row of blocks B.

The container inverting conveyor 12, which is a slat conveyor, comprises two pairs of front and rear sprockets 41, 42, right and left chains 43 reeved around the respective pairs of sprockets 41, 42, and a plurality of slats 44 extending between and attached to the chains 43.

The sprockets 41, 42 are arranged and driven intermittently so that each of the slats 44 is stopped at a block feed station S1 and then at a container feed station S2 while traveling along the upper path and thereafter at a discharge station S3 while traveling along the lower path.

Each of the slats 44 is formed with four block positioning recesses 45 and upright circular-arc stoppers 46 each extending along the front portion of the recess 45. The bottom of each recess 45 is provided with a block pushing-up member 47. As shown in detail in FIGS. 4 and 6, the block pushing-up member 47 comprises a pushing plate 48 bearing on the bottom of the recess 45, a guide rod 49 extending through the bottom of the recess 45 and having an outer end fixed to the pushing plate 48, and two rotation preventing rods 51 similarly extending through the bottom of the recess 45 in parallel to each other and attached to the plate 48 at opposite sides of the guide rod 49. The guide rod 49 has an inner end to which a spring retainer 53 having a ball 52 is fixed. A compression spring 54 is provided between the slat 44 and the spring retainer 53.

Figure 2:
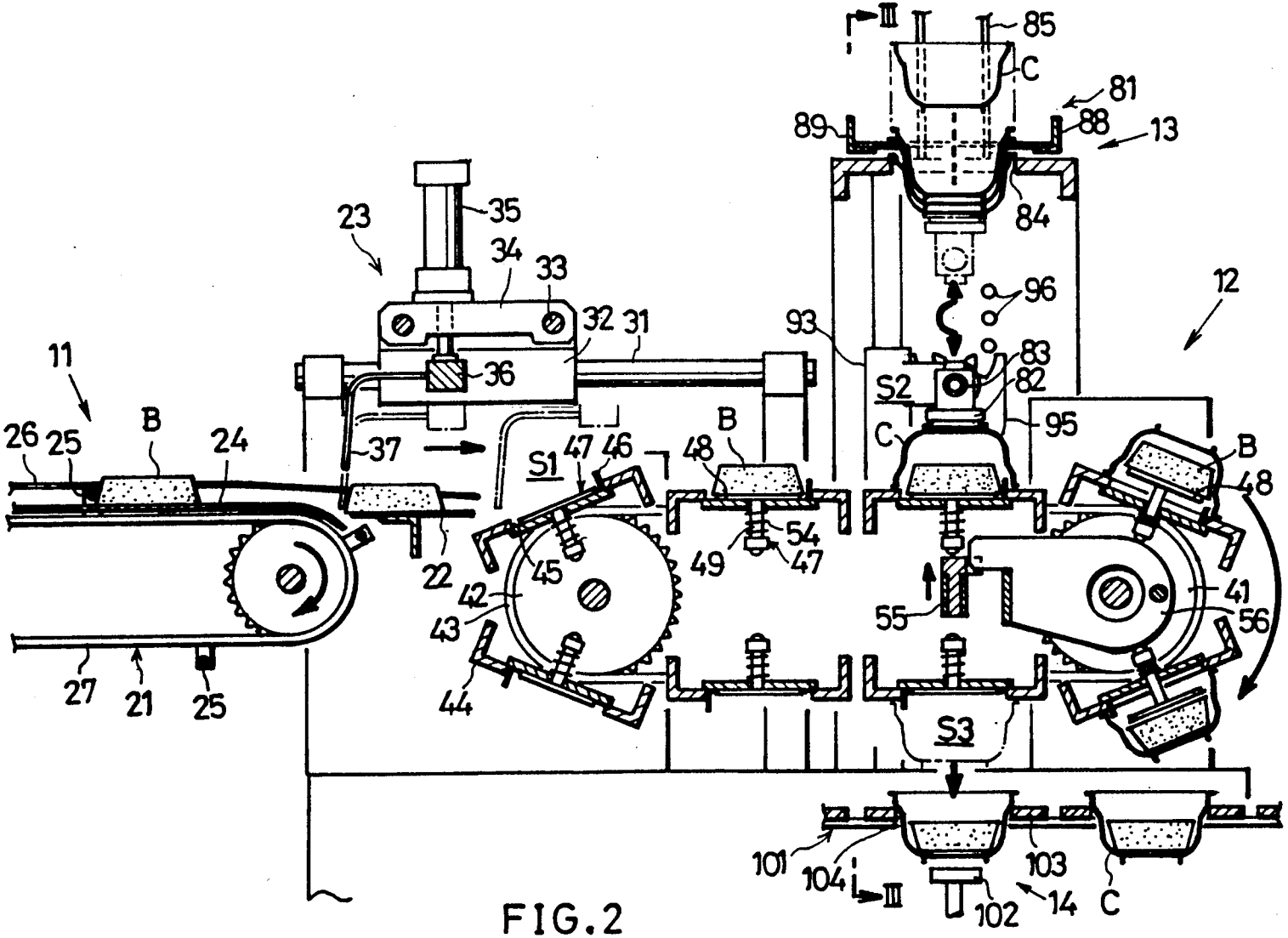
FIG. 2 is a longitudinal view in vertical section of the apparatus.
Figure 3:
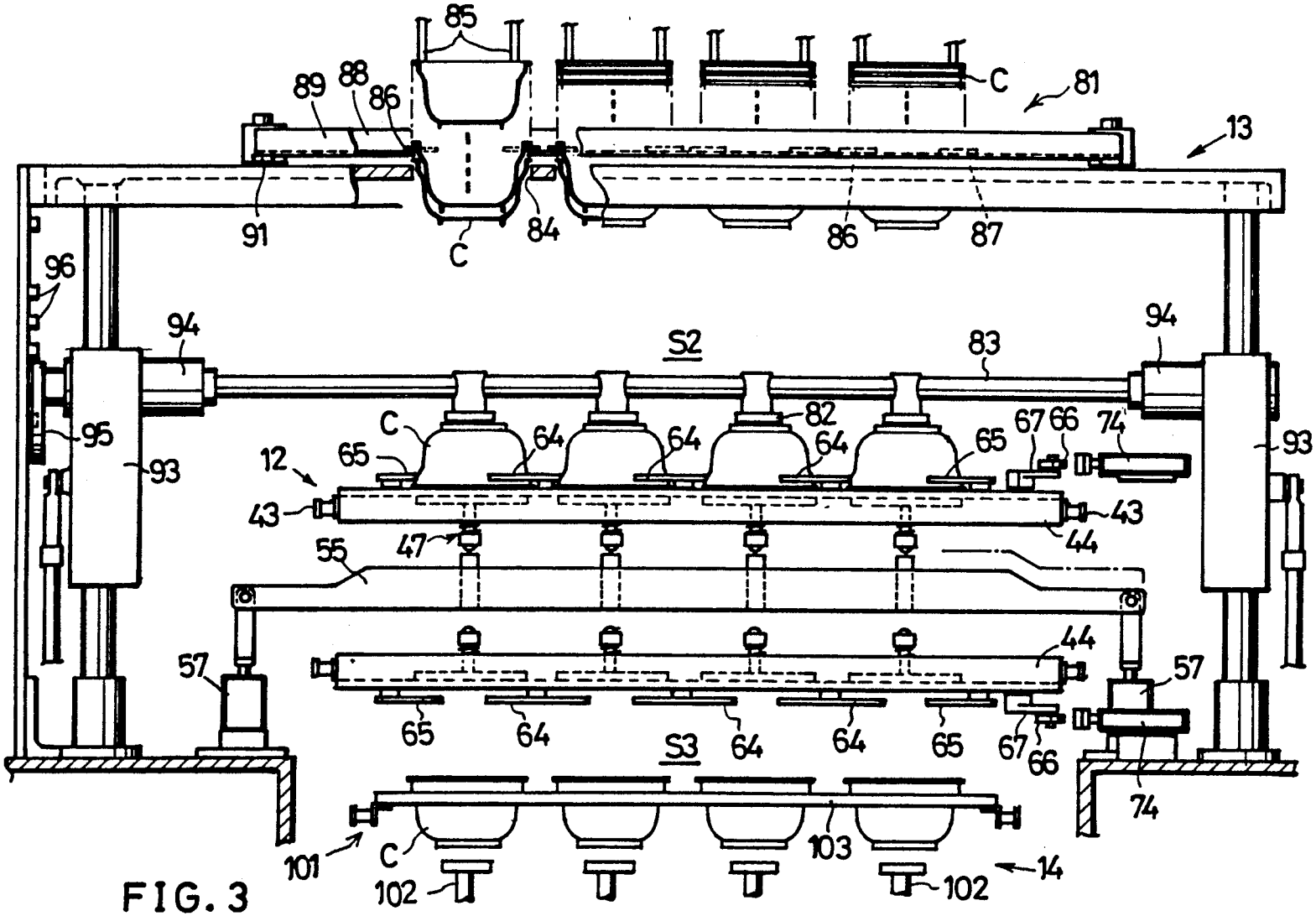
FIG. 3 is a view in vertical cross section taken along the line III—III in FIG. 2.

With reference to FIG. 2, a horizontal lift bar 55 for raising the pushing-up members 47 is disposed under the pushing-up members 47 at rest at the container feed station S2. A rail 56 for supporting and guiding the inner ends of the raised pushing-up members 47 is disposed along the path of transport from the container feed station S2 to the container discharge station S3. The rail 56 has a guide face which is so inclined as to be positioned at a larger distance from the slat as it extends toward the discharge station S3. As seen in FIG. 3, the lift bar 55 is supported at its opposite ends by the respective piston rods of two hydraulic cylinders 57 which are oriented upward.

Figure 4:
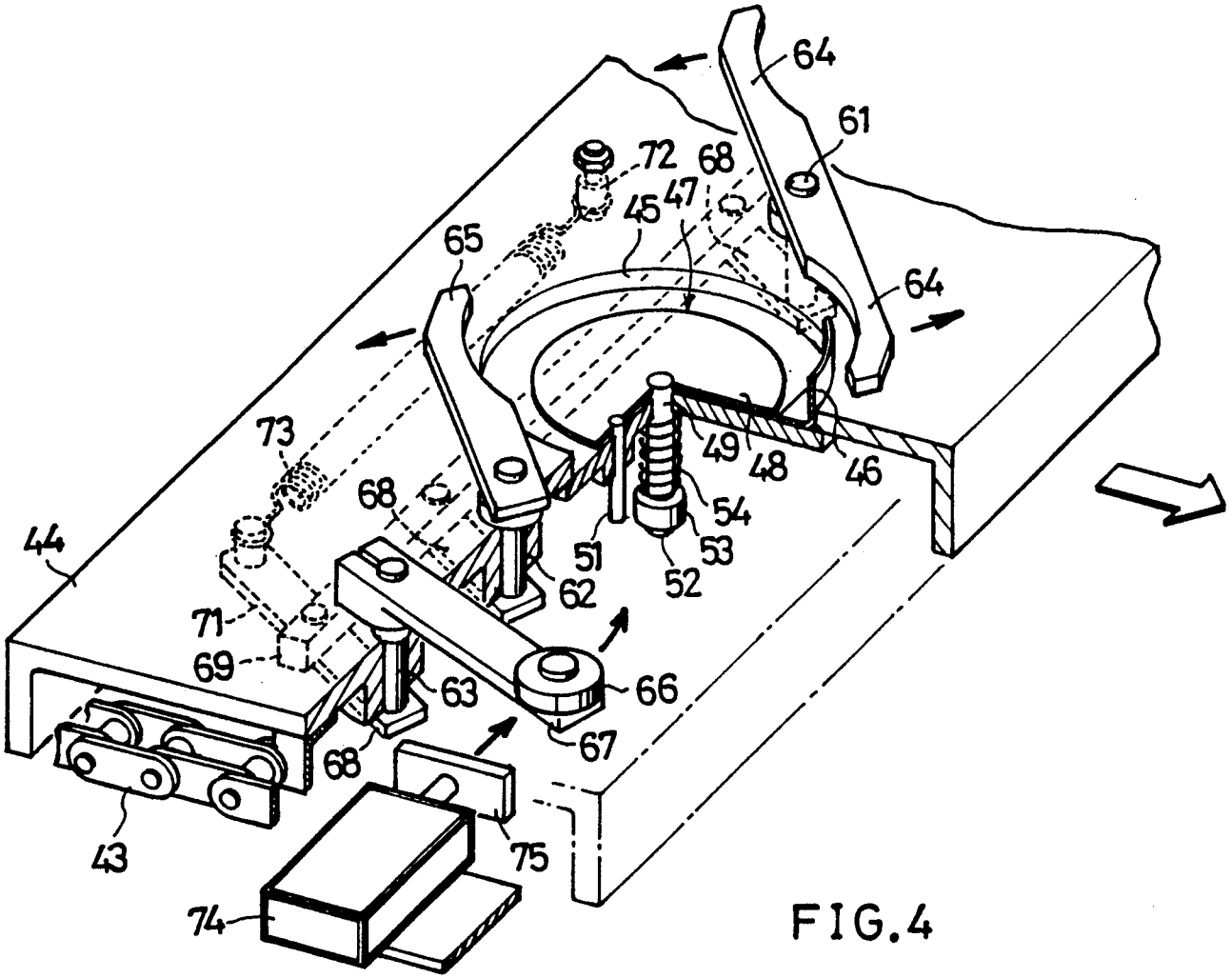
FIG. 4 is a perspective view showing a portion of a slat partly in section and means provided in the vicinity thereof.
Figure 5:
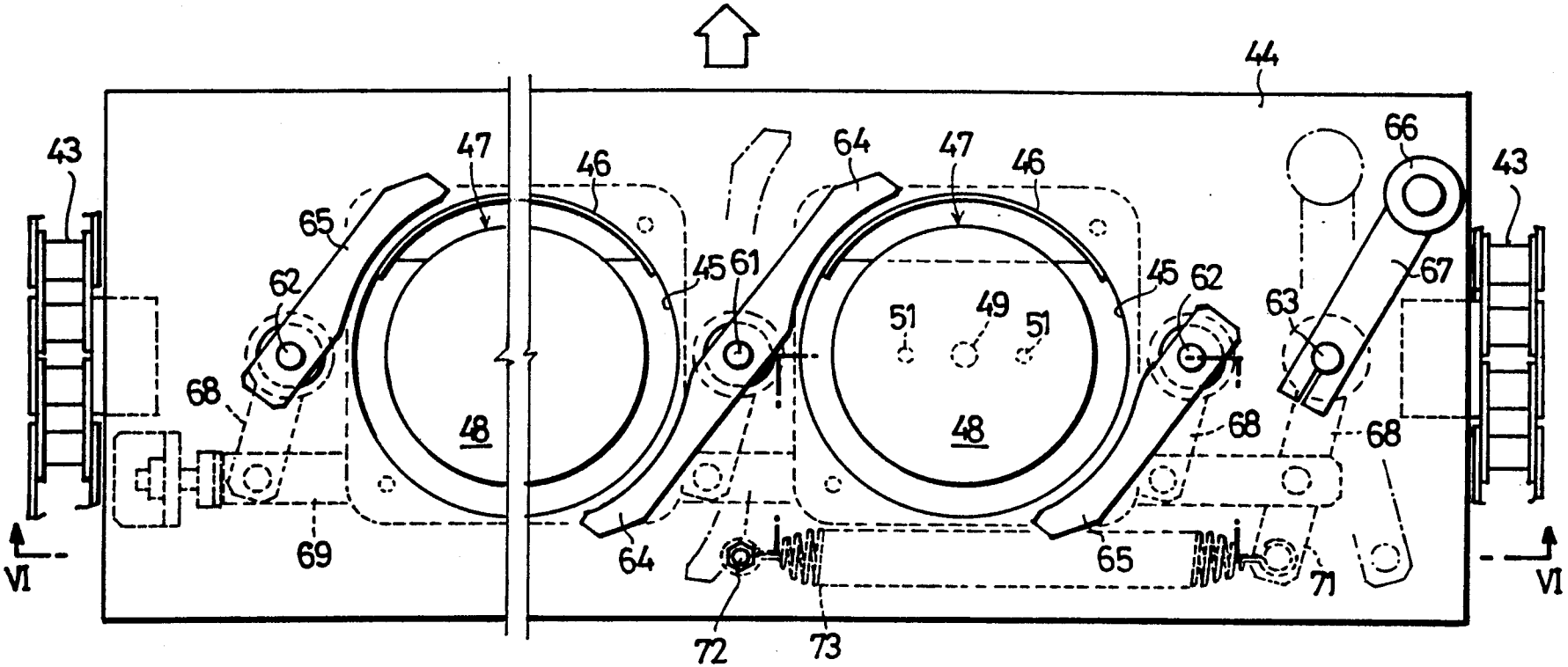
FIG. 5 is a plan view showing the same.
Figure 6:
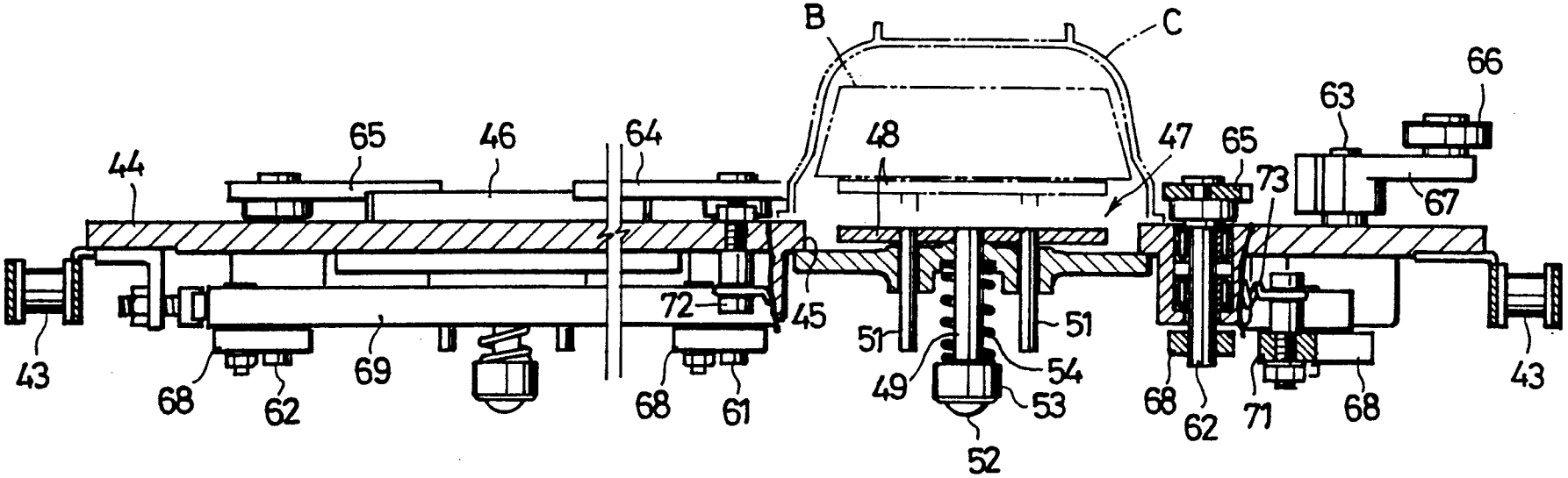
FIG. 6 is a view in section taken along the line VI—VI in FIG. 5.

With reference to FIGS. 4 to 6, first rotary shafts 61 extend through the slat 44 and are positioned between the four recesses 45, one shaft between each pair of immediately adjacent recesses. A second rotary shaft 62 extends through the slat 44 and is positioned at each of the right side of the right-end recess 45 and the left side of the left-end recess 45. A third rotary shaft 63 is further provided at the right side of the right-end second rotary shaft 62. Two first container holding arms 64 extending in directions opposite to each other are mounted on the outer end of each of the first rotary shaft 61. A second container holding arm 65 is mounted on each of the second rotary shafts 62. A driven arm 67 carrying a roller 66 at its forward end is fixed to the outer end of the third rotary shaft 63. A rotary shaft operating arm 68 is attached to the inner end of each of the first to third rotary shafts 61 to 63, and the outer ends of all the operating arms 68 are interconnected by a connecting rod 69. The operating arm 68 at the right end is provided with an extension 71 at its outer end. A compression spring 73 extends between and are engaged with the extension 71 and a spring retainer 72 provided on the lower surface of the slat 44.

With reference to FIG. 4, a driven arm operating hydraulic cylinder 74, which is oriented leftward, is disposed at the right side of the roller 66 on the forward end of the driven arm 67. A pushing member 75 in the form of a vertical flat plate is attached to the outer end of piston rod of the cylinder 74.

The piston rod, when advanced by the operation of the cylinder 74, moves the pushing member 75 leftward, pivotally moving the driven arm 67 counterclockwise in a plan view. This movement rotates the third rotary shaft 63 in the same direction to pivotally move the operating arm 68 at the right end in the same direction at the same time. This movement is transmitted to all the first and second rotary shafts 61, 62 by the connecting rod 69, moving all the container holding arms 64, 65 in the same direction along with the shafts 61, 63. Consequently, all the container holding arms 64, 65 are shifted from an operative position indicated in solid lines in FIG. 5 and inclined with respect to the direction of travel of the slat to an inoperative position indicted in broken lines in FIG. 5 and approximately parallel to the direction of travel.

With reference to FIG. 1, three driven arm operating hydraulic cylinders 74 are arranged respectively at the block feed station S1, the container feed station S2 and the container discharge station S3.

As will be most apparent from FIG. 3, the container feeder 13 comprises a stacker 81 disposed above and spaced apart from the slat 44 at rest at the container feed station S2, and a horizontal rotary shaft 83 disposed between the slat 44 and the stacker 81 and having attached thereto four suction members 82 corresponding to the four recesses 45.

The stacker 81 is formed with four downward delivery openings 84 so as to be opposed to the four recesses 45 of the slat 44, and has a plurality of vertical guide rods 85 extending upright from the edge of each opening portion 84. A multiplicity of containers C with their openings up are stacked up between the guide rods 85.

Figure 7:
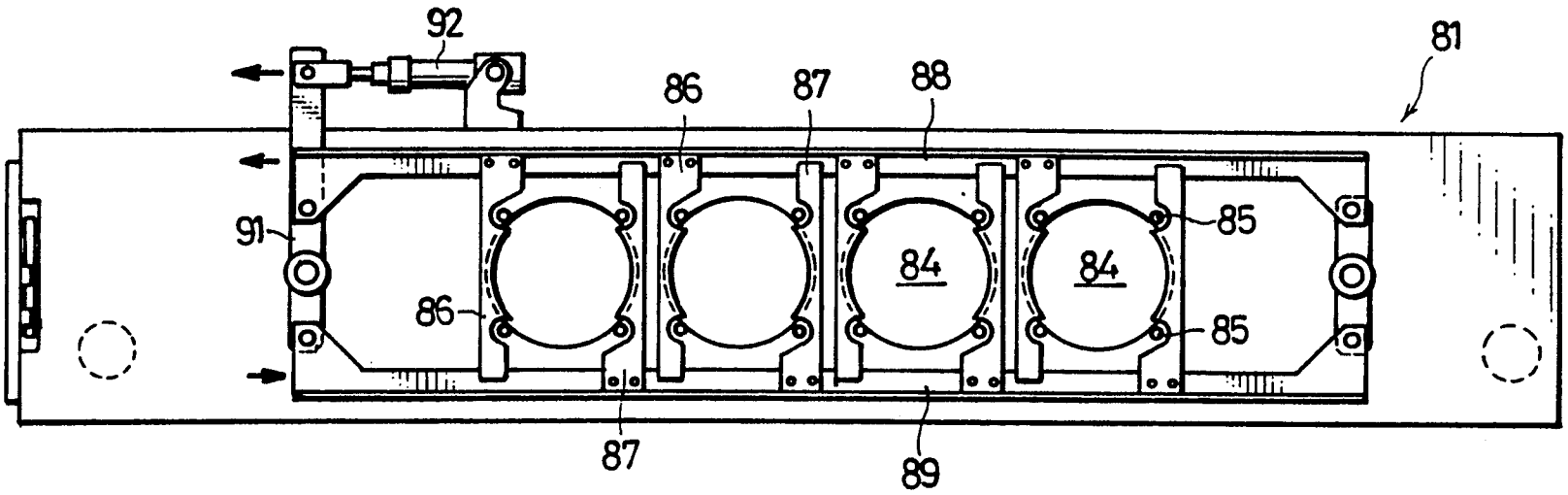
FIG. 7 is a plan view of a container feeder.

As shown in FIG. 7, a pair of stoppers 86, 87 are provided at the right and left sides of each delivery opening 84. One of the paired stoppers 86, 87 and the other stopper are connected respectively to front and rear parallel links 88, 89. The left ends of the parallel links 88, 89 are connected to an operating lever 91, one end of which is connected to the piston rod of a hydraulic cylinder 92.

When the parallel links 88, 89 are moved in directions opposite to each other by the operation of the cylinder 92, the stoppers 86, 87 in each pair are advanced into or retracted from the delivery opening 84, such that when advancing, the stoppers 86, 87 support the second container C from the lowermost against falling down.

The horizontal rotary shaft 83 is supported at its opposite ends by guide sleeves 94 mounted on a pair of right and left lift members 93. The left end of the rotary shaft 83 extends leftward beyond the guide sleeve 94. A cam plate 95 mounted on the left end is guided by a plurality of rollers 96 arranged along a path of movement of the cam plate, whereby the shaft 83 is rotated while moving upward or downward.

The container delivery device 14 comprises a delivery conveyor 101 extending forward from a position below the starting end of lower path of the container inverting conveyor 12, and a delivery lift member 102 between the two conveyors 12 and 101. The delivery conveyor 101, which is an intermittently driven slat conveyor, comprises slats 103 each adapted to stop under the container inverting slat 44 at rest at the discharge station S3. Each of the slats 103 is formed with four container holding holes 104. The delivery lift member 102 is free to move upward or downward through the container holding holes 104.

When one of the slats 44 of the inverting conveyor 12 is stopped at the block feed station S1, the container holding arms 64, 65 are moved to the inoperative position,.and in this state, blocks B transported to the terminal end of path of transport are sent into the respective recesses 45 of the slat 44 by the pusher 23, whereupon the arms 64, 65 are brought to the operative position. The slat 44 is advanced by one pitch. When the slat 44 is subsequently driven further by one pitch, the blocks B in the recesses 45 are sent to the container feed station S2, whereupon the holding arms 64, 65 are brought to the inoperative position again. In this state, the container feeder 13 fits containers C as turned upside down over the respective blocks B. The holding arms 64, 65 are then returned to the operative position to hold the containers C from opposite sides thereof. Simultaneously with this or immediately thereafter, the block pushing-up members 47 of the slat 44 concerned are raised by the lift bar 55, whereby each block B is pushed up to the bottom of the container C. When the slat 44 is subsequently driven by three pitches, the slat 44 reaches the discharge station S3. During this travel, the pushing-up members 47 are guided by the rail 56 and thereby held raised, while the containers C are inverted. When the slat 44 approaches the discharge station S3, the pushing-up members 47 reach the inclined portion of the rail 56 and rise to return to the original position. When the slat 44 is brought to a halt at the discharge station S3, the container holding arms 64, 65 are moved to the inoperative position, whereupon the block-filled containers C are released from the holding arms, fall off the slat 44 onto the delivery lift member 102 waiting immediately therebelow and are delivered by the lift member 102 to the delivery conveyor 101.

What is claimed is:

1. A block filling apparatus comprising:

an apparatus frame having a block feed station, a container feed station horizontally spaced apart therefrom and a discharge station vertically spaced apart from the block feed and container feed stations, driven arm operating hydraulic cylinders each having a pushing member attached to a piston rod and being disposed respectively at said block feed station, said container feed station, and said discharge station, an intermittently driven container-inverting slat conveyor having a plurality of slats, an upper path of travel of the slats and a lower path of travel of the slats, the conveyor constructed so that each of the slats is stopped at the block feed station and then at the container feed station while traveling along the upper path and thereafter at the discharge station while traveling along the lower path, each slat having a plurality of block positioning recesses formed in a row and in a longitudinal direction on a surface of each slat, means for feeding a block to the slat stopped at the block feed station, means for feeding a container to the slat stopped at the container feed station to cover the block fed thereto with an upside down container, a pair of container holding arms disposed at opposite sides of each block positioning recess of each slat for releasably holding a container fed thereto, each pair of holding arms extending in opposite directions, means for operating the holding arms to cause the holding arms to hold the respective container at the container feed station and to cause the holding arms to release the respective container at the discharge station, the means for operating the holding arms comprising, a driven arm driven by said driven arm operating hydraulic cylinders and disposed adjacent an outer holding arm positioned at a recess at the end of each row of recesses of each slat, said driven arm of each slat having a base portion connected to a driven operating arm via a driven arm rotary shaft extending through the respective slat, a plurality of container holding arm rotary shafts extending through each respective slat, each container holding arm rotary shaft having a first end portion connected to a base portion of each container holding arm, a plurality of rotary shaft operating arms each having a first end portion connected to a second end portion of a respective container holding arm rotary shaft, an operating arm connecting rod, wherein each rotary shaft operating arm has a second end portion connected to said operating arm connecting rod, and wherein said operating arm connecting rod is connected to said driven operating arm and is biased by a spring connected to said driven operating arm so as to bias each container holding arm in the row of recesses of the respective slat.

2. An apparatus as defined in claim 1 wherein the slat is provided with a block pushing-up member movable in a direction perpendicular to a surface of the slat, and a multiplicity of containers, each container having a top opening, the openings facing up in the stacker, and a horizontal rotary shaft disposed between the stacker and the slat and having a container suction member attached thereto.

3. An apparatus as defined in claim 1 wherein the block feeding means comprises a block conveyor having a transport path terminal end opposed to the upper path of the container-inverting conveyor, a bridge plate interconnecting the block conveyor and the container-inverting conveyor, and a pusher for pushing the block from the block conveyor onto the container-inverting conveyor over the bridge plate.

4. An apparatus as defined in claim 3 wherein the block conveyor comprises a slide plate for guiding the block by supporting a bottom thereof, a pair of endless chains arranged respectively at opposite sides of the slide plate, and push bars extending between and attached to the chains and arranged at a specified spacing.

5. An apparatus as defined in claim 1 wherein the container feeding means comprises a stacker disposed above the slat stopped at the container feed station and having stacked up therein means is provided for operating the pushing-up member so that the block is pushed up from the slat to a bottom of the container while the slat travels from the container feed station to the discharge station.

* * * * *